US005318236A

United States Patent [19]

Morello et al.

[11] Patent Number: 5,318,236

[45] Date of Patent: Jun. 7, 1994

[54] ADJUSTABLE DECOILING DEVICE

[75] Inventors: Frederick Morello; Christopher K. Kastner, both of Johnstown, Pa.

[73] Assignee: M.I.C. Industries, Inc., Reston, Va.

[21] Appl. No.: 933,070

[22] Filed: Aug. 21, 1992

[51] Int. Cl.[5] ..... B65H 49/06

[52] U.S. Cl. ..... 242/72 R; 242/72.1

[58] Field of Search ..... 242/72 R, 72.1, 78.6, 242/110.2; 269/48.1; 279/2.1, 2.16, 2.19, 2.24

[56] References Cited

U.S. PATENT DOCUMENTS

| | | | |
|---|---|---|---|
| 442,309 | 12/1890 | Diamond et al. . | |
| 811,357 | 1/1906 | Van Azary | 242/110.2 |
| 1,007,413 | 10/1911 | Baker | 279/2.19 |
| 1,093,284 | 4/1914 | Mehlum | 242/72 R |
| 1,260,786 | 3/1918 | Manz | 242/110.2 |
| 1,846,767 | 2/1932 | Steuer et al. | 242/72.1 |
| 2,250,367 | 7/1941 | Gilbert | 242/68 |
| 2,370,868 | 3/1945 | Luebke | 242/112 |
| 2,460,325 | 2/1949 | Whitson et al. | 242/72.1 |
| 2,464,676 | 3/1949 | Dotsch | 242/105 |
| 2,682,924 | 7/1954 | Lowazzo et al. | 279/2.16 |
| 2,809,674 | 10/1957 | Ward | 242/72 R |
| 2,851,227 | 4/1956 | Bergelson | 242/72.1 |
| 2,875,962 | 3/1959 | Lanstrom | 242/128 |
| 3,231,213 | 1/1966 | Shumaker | 242/78.7 |
| 3,244,380 | 4/1966 | Hoyne | 242/78.6 |
| 3,730,451 | 5/1973 | Iddings | 242/68 |
| 3,940,084 | 2/1976 | Leahy | 242/110.2 |
| 3,952,961 | 4/1976 | Antepenko | 242/54 |
| 3,989,202 | 11/1976 | Noé et al. | 242/72 R |
| 4,061,289 | 12/1977 | Miura et al. | 242/72 R X |
| 4,694,559 | 9/1987 | Lundy et al. | 29/559 |
| 4,995,569 | 2/1991 | Alexander | 242/110.2 X |

FOREIGN PATENT DOCUMENTS

| | | | |
|---|---|---|---|
| 2048176 | 3/1971 | France | 242/72 R |

OTHER PUBLICATIONS

ESE Machines Inc. brochure-"New 5 Prong Design Decoiler," Date unknown.

*Primary Examiner*—Daniel P. Stodola
*Assistant Examiner*—John P. Darling
*Attorney, Agent, or Firm*—Rothwell, Figg, Ernst & Kurz

[57] ABSTRACT

A device for insertion into a roll of coiled sheet material to rotatably support the roll during decoiling. The device includes a hub assembly with an axle and a pair of rotatable hub centers that are connected to a plurality of support members. One of the hub centers is moved toward the other to adjust the support members. The support members are radially movable with respect to the axle and engage the interior surface of the hollow core of the roll. The device has bearings which allow free rotation of the hub centers while under load from the roll. A torque limiter is disposed on the device to prevent undesired decoiling of the roll.

16 Claims, 2 Drawing Sheets

ADJUSTABLE DECOILING DEVICE

BACKGROUND OF THE INVENTION

1. Field of the Invention

This invention relates to improvements in roll or coil holders and particularly to an adjustable decoiling device.

2. Description of the Prior Art

Devices for insertion into the hollow core of a roll or coil of material to support the roll or coil and to facilitate its unwinding are known. It is also known to use an adjustable device to accommodate rolls or coils with different inside diameters, see for example, U.S. Pat. Nos. 442,309 and 2,875,962.

Rolls of sheet steel are used in forming and bending sheet metal into arcuate panels which may be joined together along adjacent seams to form arched metal buildings. Machines for this purpose are made by MIC Industries, Inc. of Reston, Va.

There is a need in the art for a device which can rotatably support these large heavy rolls of sheet steel while it is fed into the various shaping, shearing and bending sections which form the sheet steel into the arcuate building panels.

These rolls of sheet steel are typically uncoiled by placing a core having a size slightly less than the inside diameter of the roll inside the hollow center of the roll. The ends of the core extend past the ends of the roll and are supported so that the roll can be rotated to dispense sheet steel.

With this known arrangement, only a certain size core can be used with a particular size roll of sheet steel. It is therefore necessary to keep various size cores on hand for use with different size rolls of sheet steel. Rotation of the large heavy roll can be difficult when using such a core.

Another problem arises as a result of an inturned lip portion formed on the inside edge of the roll of sheet steel. This lip extends into the hollow center of the roll and must be cut off to enable placement of the above described core in the roll.

SUMMARY OF THE INVENTION

The present invention provides an adjustable decoiling device for insertion into the hollow core of a roll or coil of sheet steel. The device is radially expandable so that it can be used with rolls of sheet stock having different inside diameters.

The uncoiling device includes a hub assembly having an axle with a pair of hub centers rotatably mounted thereon. The hub centers are connected to support members which engage the interior surface of the hollow core of the roll or coil. Means are provided for adjusting the position of the hub centers on the axle. This adjusts the position of the support members relative to the interior surface of the roll.

The inturned lip portion formed on the inside of the roll is utilized to further secure the device to the roll by positioning the lip against one of the support members.

The hub centers are provided with heavy duty bearings to allow smooth rotation of the roll about the axle while supporting very heavy rolls of steel.

The device has a torque limiter which can be selectively set to a desired level to prevent undesired rotation of the hub assembly and uncoiling of the roll.

The hub centers can be locked in place on the axle with the support members engaging the inner surface of the roll. The hub assembly and roll are placed on a stand or structure which supports the ends of the axle while allowing the hub centers and roll to rotate and dispense sheet stock.

DETAILED DESCRIPTION OF THE DRAWINGS

Figure 1:
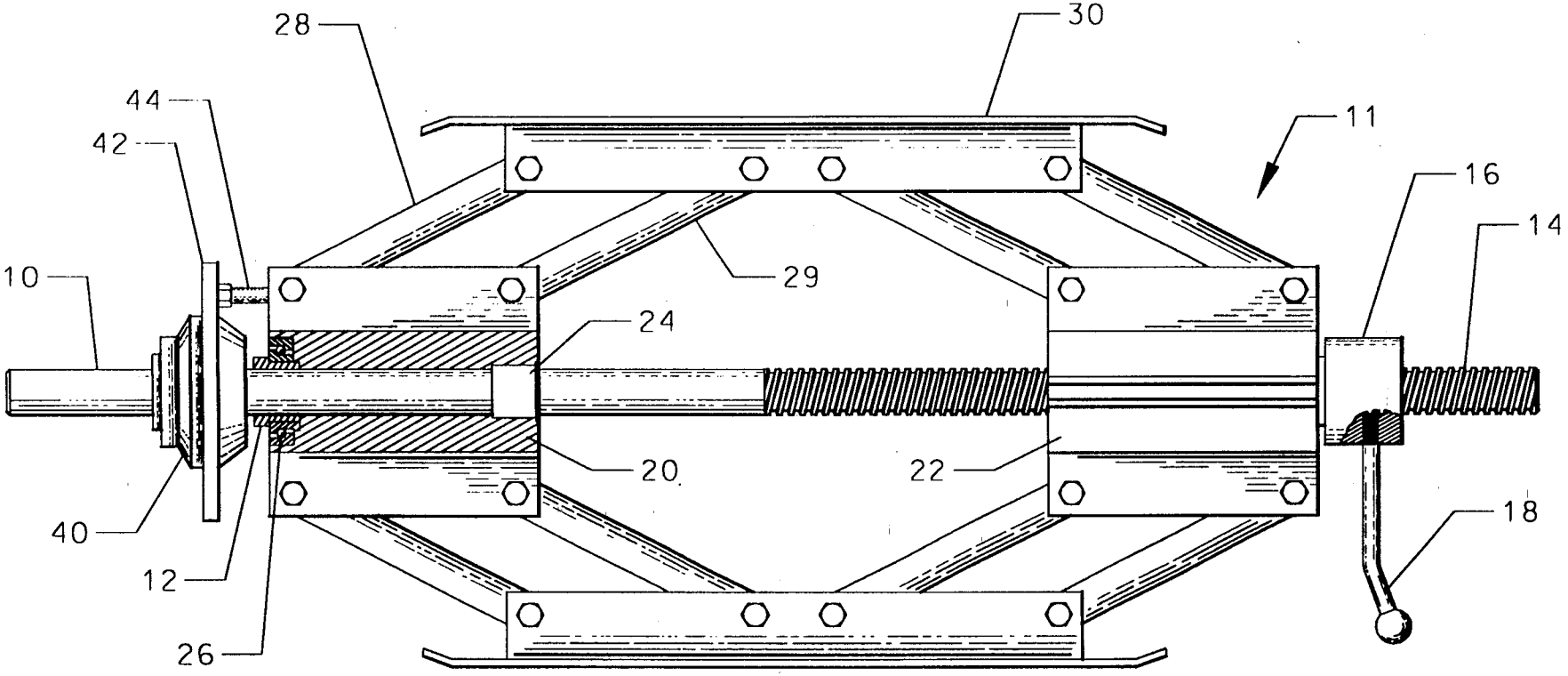
FIG. 1 is an elevational front view of the hub assembly of the present invention with the support members partially extended.

Referring to FIG. 1, the reference numeral 11 indicates a hub assembly for insertion into a roll of coiled stock material. The hub assembly includes an axle 10 with a stop collar 12 and a threaded portion 14. The threaded portion 14 extends over approximately one half of the axle. The stop collar 12 is welded to the axle opposite the threaded portion 14. The axle 10 is adapted to be placed in a stand which supports the ends of the axle while permitting the roll of steel to rotate and uncoil the steel from the roll.

A pair of hub centers 20,22 are disposed on the axle 10 and can rotate freely thereabout. The hub center 22 is movable horizontally along the axle but the hub center 20 is prevented from such movement. The hub center 20, shown in section in FIG. 1, is disposed adjacent stop collar 12 and is forced against the collar by connecting members 28,29 to constrain horizontal movement of hub center 20 along the axle 10.

The hub centers 20,22 are each connected to a plurality of support members 30 by connecting members 28,29. The support members 30 are plate shaped and engage the interior surface of the hollow core of the roll of steel. The support members 30 have a surface area large enough to distribute the load and reduce concentrated stresses from the roll of steel. There are four support members 30 in the embodiment shown in FIGS. 1 and 2.

The connecting members 28,29 are rod or bar members which comprise four spoke assemblies connecting hub centers 20,22 to support members 30. Each spoke assembly includes connecting members 28,29 which have one end pivotally secured to one of the hub centers and the other end pivotally secured to one of the support members 30. The connecting members 28,29 thus secure hub centers 20,22 to opposite ends of each of the support members 30.

The movement of hub center 22 toward hub center 20 changes the relative angle of the connecting members 28,29 by causing them to pivot and drive support members 30 radially outward into engagement with the interior surface of the roll. The connecting members 28,29 can then be locked at the angle corresponding to this position. The allowable range of critical angles for the connecting members 28,29 is thirty to sixty degrees. There are a total of sixteen connecting members in the embodiment of FIGS. 1 and 2. The connecting members 28,29 and their specified critical angles provide support strength and safety under heavy loads.

The hub center 22 may be moved axially by a drive member in the form of a cylindrical nut 16 which is threaded to threaded portion 14 of the axle 10. A handle member 18 is threaded into the nut 16 and serves as means for rotating the nut 16 which moves hub center 22. The handle also acts as a set screw to lock the position of the nut 16 and hub center 22 by threading the handle through the nut into engagement with the axle 10. This feature is utilized to lock the position of the hub center 22 and the connecting members 28,29 forcing the support members 30 against the inner diameter of the roll.

The hub assembly of the present invention is provided with heavy duty bearings for easy rotation of the hub centers 20,22 about the axle 10. Each hub center has a bronze flange bearing 24 and an angular contact bearing 26 on opposite ends to allow free rotation under heavy load from the roll of steel.

The present invention also includes torque limiter means 40 to prevent undesired unwinding due to angular momentum of the roll. The torque limiter is of known construction and includes a plate 42 secured to the axle adjacent the fixed hub center 20. A bolt 44 projects inwardly from the plate 42 and contacts hub center 20 when the hub assembly and roll rotate. This contact actuates the torque limiter means 40 which provides a preselected resistance to rotation of the hub assembly and the roll. Thus, undesired unwinding or unrolling due to angular momentum of the assembly and roll is prevented.

Figure 2:
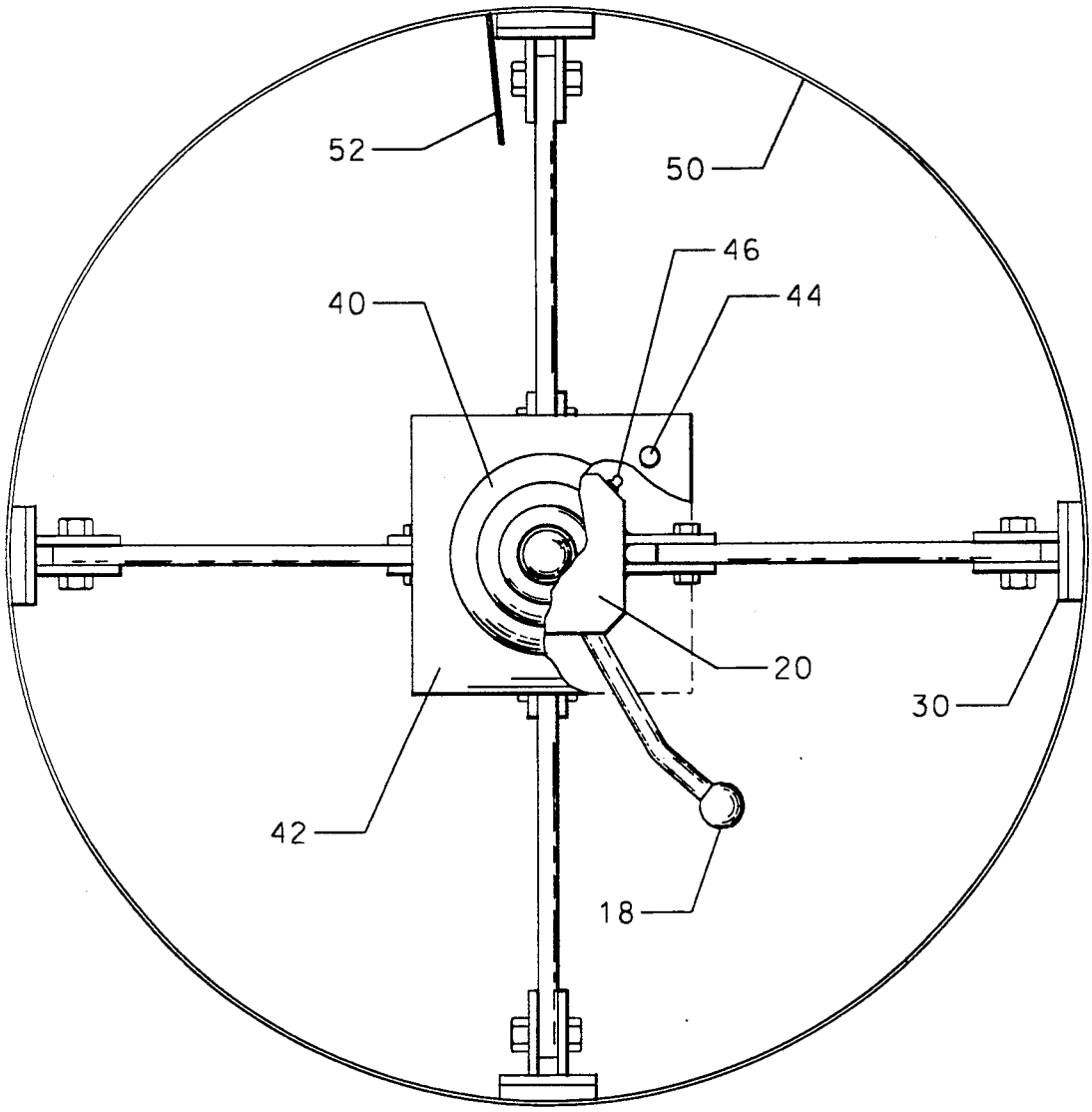
FIG. 2 is an elevational view of the hub assembly of the present invention positioned in the interior of a roll of coiled sheet material with the support members engaging the interior surface of the roll.

FIG. 2 shows the hub assembly of the present invention disposed inside a roll of sheet steel 50. The connecting members 28,29 are extended and four support members 30 are in engagement with the interior surface of the hollow core of the roll of sheet steel 50. A grease fitting 46 is provided in hub centers 20,22 to permit lubrication for smooth rotation. A terminal edge or lip portion 52 of the roll 50 fits against one of the support members 30 to further secure the assembly to the roll of sheet steel.

The operation of the uncoiling device will now be described. A heavy roll or coil of sheet steel is stationary, e.g. on the ground. The hub assembly 11 is positioned next to the roll and slid inside the roll so that the lip portion 52 rests against one of the support members 30.

The handle 18 is then cranked about the axle 10 to rotate the driving nut 16. This moves hub center 22 towards hub center 20, pivoting connecting members 28,29 and moving support members 30 into engagement with the interior surface of the roll. Next the handle 18 is rotated relative to the driving nut 16 until the handle abuts the axle 10 as a set screw and locks the driving nut in place.

The entire hub assembly and the roll are lifted and placed in a proper stand or support (not shown). In this position, the axle 10 is supported by the stand and the hub assembly and roll are free to rotate about the axle to dispense the sheet steel. The torque limiter means 40 is then adjusted to provide sufficient rotation resistance so that the hub assembly and roll do not continue to turn from angular momentum after dispensing has been stopped.

I claim:

1. A decoiling device for insertion into a hollow core of a roll of coiled sheet material, comprising:

a hub axle adapted to be supported at its ends and having two hub center rotatably mounted thereon;

one of the hub centers mounted so as to be movable horizontally along the axle and the other hub center mounted so as to be constrained from horizontal movement along the axle;

a plurality of support members each having means for engaging an interior surface of the hollow core of the roll of coiled sheet material;

a plurality of connecting members each having one end pivotally connected to one of the hub centers and another end pivotally connected to one of the plurality of support members;

means for moving one hub center towards the other hub center, after said decoiling device has been fully inserted into the hollow core of the roll, to pivot the plurality of connecting members and move the plurality of support members into engagement with the interior surface of the roll.

2. A decoiling device as in claim 1 wherein the hub axle has a threaded portion and the moving means includes a rotatable driving member threadedly mounted on the threaded portion of the hub axle to engage and move the one hub center.

3. A decoiling device as in claim 2 wherein the driving member has a handle mounted thereto for rotating the driving member to move the one hub center, the handle being threaded into the drive member and adapted to be rotated into the drive member to extend therethrough until the handle abuts the axle to lock the drive member to the axle.

4. A decoiling device as in claim 1 further including means for limiting rotation of the roll to prevent undesired uncoiling.

5. A decoiling device as in claim 4 wherein the rotation limiting means includes a plate mounted on the hub axle and a bolt secured to and projecting from the plate, the bolt positioned to engage one of the hub centers to provide a predetermined resistance to rotation of the hub centers and the roll.

6. A decoiling device as in claim 1 wherein the hub centers are provided with bearings which allow free rotation while under heavy load from the roll.

7. A decoiling device as in claim 6 wherein the bearings include a flange bearing fitted on one end of each of the hub centers, and an angular contact bearing fitted on an opposite end of each of the hub centers.

8. An adjustable hub assembly for insertion into a roll of coiled sheet steel to facilitate decoiling the roll, the hub assembly comprising:

an axle;

first and second hub members rotatably mounted on the axle, the first hub member being movable horizontally along the axle and the second hub member being prevented from moving horizontally on the axle;

the axle having a threaded portion with a threaded drive collar mounted thereon adjacent the first hub member;

a plurality of connecting members secured to and extending from the hub members;

a plurality of support plates secured to the plurality of connecting members opposite the hub members;

means for rotating the drive collar to move the first hub member horizontally along the axle towards the second hub member, causing the plurality of connecting members to force the plurality of support plates radially outward until the support plates engage an interior surface of the roll of sheet steel.

9. A decoiling hub assembly as in claim 8 wherein the means for rotating the drive collar includes a handle mounted on the drive collar for rotating the drive collar to move the one hub center.

10. A decoiling hub assembly as in claim 9 wherein the handle is threaded into the drive collar and can be rotated to extend therethrough until the handle abuts the axle to lock the drive collar to the axle.

11. A decoiling hub assembly as in claim 10 wherein the bearings include a flange bearing fitted on one end of each of the hub centers, and an angular contact bearing fitted on an opposite end of each of the hub centers.

12. A decoiling hub assembly as in claim 8 wherein the hub centers are provided with bearings which allow free rotation while under heavy load from the roll.

13. A decoiling hub assembly as in claim 8 further including means for limiting rotation of the roll to prevent undesired uncoiling.

14. A decoiling hub assembly as in claim 13 wherein the rotation limiting means includes a plate mounted on the hub axle and a bolt secured to and projecting from the plate, the bolt being positioned to engage one of the hub centers to provide a predetermined resistance to rotation of the hub centers and the roll.

15. A decoiling hub assembly as in claim 8 wherein the roll has a bent inside edge portion extending toward the center of the roll, and each of the support plates has means to fit between the edge portion and the interior surface of the roll to secure the assembly to the roll.

16. In combination with a roll of coiled sheet material having a hollow center forming an interior surface and an terminal edge portion bent to extend into the hollow center, an adjustable decoiling device inserted in the roll, the decoiling device comprising:

a hub axle adapted to be supported at its ends and having two hub centers rotatably mounted thereon;

one of the hub centers being horizontally movable along the axle toward the other hub center;

a plurality of support members each having means to engage an interior surface of the hollow core of the roll of coiled sheet material and to fit between the edge portion and the interior surface of the roll, the plurality of support members being disposed against the interior surface of the roll with one support member positioned against the terminal edge portion to lock the device to the roll;

a plurality of connecting members each having one end connected to one of the hub centers and another end connected to one of the plurality of support members;

adjusting means for moving the one hub center towards the other hub center to cause the plurality of connecting members to move the plurality of support members into engagement with the interior surface of the roll.

* * * * *

UNITED STATES PATENT AND TRADEMARK OFFICE

CERTIFICATE OF CORRECTION

PATENT NO. : 5,318,236

DATED : June 7, 1994

INVENTOR(S) : Frederick Morello et al.

It is certified that error appears in the above-identified patent and that said Letters Patent is hereby corrected as shown below:

Col. 2, line 7, delete "front".

Col. 3, line 66, "center" should be --centers--.

Signed and Sealed this

Sixth Day of September, 1994

Bruce Lehman

*Attest:*

BRUCE LEHMAN

*Attesting Officer*

*Commissioner of Patents and Trademarks*